US006062136A

United States Patent [19]

Bolza-Schünemann

[11] Patent Number: 6,062,136

[45] Date of Patent: May 16, 2000

[54] SHEET-FED OFFSET ROTARY PRESS

[75] Inventor: Hans-Bernhard Bolza-Schünemann, Würzburg, Germany

[73] Assignee: Koenig & Bauer-Albert Aktiengesellschaft, Wurzburg, Germany

[21] Appl. No.: 09/374,104

[22] Filed: Aug. 16, 1999

Related U.S. Application Data

[62] Division of application No. 08/973,761, Dec. 30, 1997, and a division of application No. PCT/DE96/01102, Jun. 22, 1996.

[30] Foreign Application Priority Data

Jun. 30, 1995 [DE] Germany ..... 195 23 378

[51] Int. Cl.[7] ..... B41F 7/08

[52] U.S. Cl. ..... 101/137; 183/364; 183/210

[58] Field of Search ..... 101/181, 183, 101/210, 206, 207, 212, 216, 217, 364, 365, 366, 367, 141, 142, 137

[56] References Cited

U.S. PATENT DOCUMENTS

| | | | |
|---|---|---|---|
| 1,880,369 | 10/1932 | Turck . | |
| 1,919,462 | 7/1933 | Claybourn . | |
| 1,941,241 | 12/1933 | Barber . | |
| 2,132,086 | 10/1938 | Scheffler | 101/210 |
| 2,663,254 | 12/1953 | Parrish . | |
| 3,384,011 | 5/1968 | Bolza-Schunemann . | |
| 3,744,413 | 7/1973 | Wolff | 101/142 |
| 4,231,291 | 11/1980 | Davidson, Jr. | 101/137 |
| 4,527,476 | 7/1985 | Ducournau et al. . | |
| 4,782,753 | 11/1988 | Bolza-Schunemann . | |
| 4,854,232 | 8/1989 | Oda | 101/137 |
| 4,976,197 | 12/1990 | Yamanari et al. | 101/137 |
| 5,012,736 | 5/1991 | Van Kanegan et al. | 101/210 |
| 5,044,277 | 9/1991 | John | 101/367 |
| 5,469,787 | 11/1995 | Turner et al. . | |
| 5,540,150 | 7/1996 | Lewis et al. . | |
| 5,819,661 | 10/1998 | Lewis et al. . | |

FOREIGN PATENT DOCUMENTS

| | | |
|---|---|---|
| 0359957 A2 | 8/1989 | European Pat. Off. . |
| 564212 | 12/1923 | France . |
| 434474 | 6/1888 | Germany . |
| 238264 | 9/1911 | Germany . |
| 432853 | 9/1926 | Germany . |
| 435592 | 10/1926 | Germany . |
| 521874 | 3/1931 | Germany . |
| 4303797 A1 | 8/1994 | Germany . |
| 10154 | 7/1916 | United Kingdom . |
| WO 90/02044 | 3/1990 | WIPO . |
| WO 95/25015 | 9/1995 | WIPO . |

*Primary Examiner*—Eugene Eickholt
*Attorney, Agent, or Firm*—Jones, Tullar & cooper, P.C.

[57] ABSTRACT

A sheet-fed rotary offset printing machine accomplishes multi-color printing. A central impression cylinder carries sheets to be printed as they pass by at least two serially located blanket cylinders. These blanket cylinders are provided with ink images from cooperating plate cylinders. A sheet is gripped only once by grippers of the impression cylinder and is held in this single gripping operation during printing. At least one short inking unit is associated with each printing cylinder.

6 Claims, 2 Drawing Sheets

SHEET-FED OFFSET ROTARY PRESS

This application is a divisional of copending application Ser. No. 08/973,761 filed on Dec. 30, 1997 and a division of International Application PCT/DE96/01102 filed on Jun. 22, 1996 and which designated the U.S.

FIELD OF THE INVENTION

The present invention relates to a sheet-fed offset rotary printing press.

DESCRIPTION OF THE PRIOR ART

A three-cylinder rotary rubber blanket printing press is known from DE-PS 435 592, wherein the plate and rubber blanket cylinders each have at least two print areas, and an impression cylinder has one more print area than the rubber blanket cylinder.

It is disadvantageous in connection with this prior printing press that registration problems can occur, since a sheet to be printed is already removed from the impression cylinder by a gripper system before this sheet has been completely printed.

DE 43 03 797 A1 and FR-A-564 212 disclose sheet-fed offset printing presses wherein a sheet is taken over by a sheet-delivering gripper system only at the termination of the printing process between a rubber blanket cylinder and printing cylinder.

WO 90/02044 describes a rotary printing press with a printing plate which is arranged on a printing cylinder and can be inscribed by a laser. An axially displaceable laser inscribing system is associated with the printing cylinder.

A sheet-fed rotary printing press for multi-color printing with a central impression cylinder is known from GB-A-10 154. A printing cylinder having two print areas is associated with this printing cylinder.

EP 0 359 957 A2 discloses a printing press with a short inking unit. The short inking unit essentially consists of a chamber doctor blade, a rotating roller and an in application roller.

DE-PS 521 874 describes a sheet-fed rotary printing press for direct multi-color printing, with a printing cylinder and an impression cylinder. In this case the printing cylinder has four print areas and the impression cylinder has five gripper systems.

U.S. Pat. No. 1,919,462 discloses a sheet-fed rotary printing press for direct multi-color printing, wherein five printing cylinders are associated with a central impression cylinder.

SUMMARY OF THE INVENTION

It is the object of the present invention to provide a sheet-fed rotary offset printing press.

In accordance with the present invention, this object is attained by a sheet-fed offset rotary printing press which includes a first printing cylinder, a first rubber blanket cylinder and a central impression cylinder that is provided with a plurality of controlled gripper systems. A second printing cylinder and a second blanket cylinder are also associated with the central impression cylinder. A stack of sheets to be printed and a stack of printed sheets are both positioned on the same side of the sheet-fed offset rotary printing press. The printing cylinders and the blanket cylinders have the same diameters and each have at least two print areas. The number of gripper systems of the impression cylinder is not equal to the number of print areas on each of the printing cylinders. A sheet delivery gripper system is associated with the impression cylinder in a manner such that a sheet of a maximum format length is taken over by this gripper system only upon completion of the printing process between the rubber blanket cylinder and the impression cylinder. A short inking unit may be associated with each print area of each of the printing cylinders. Ink application rollers of these short inking units can be moved into and out of engagement with their associated printing cylinders.

Multi-color printing with a registration of the greatest accuracy is achieved in an advantageous manner by means of the sheet-fed offset rotary printing press in accordance with the present invention, since during all printing steps the sheets to be printed are maintained in a single gripper system on an impression cylinder. Only after the sheet has been completely printed are each of the printed sheets taken over by a second gripper system and removed from the impression cylinder.

By the utilization of a sheet-feeding device that is synchronized with the impression cylinder, and which accelerates the sheets to be fed in from a state of rest to the circumferential speed of the impression cylinder, assured sheet-feeding with very accurate contact registration is achieved. This is possible even at high speeds for example at speeds of 12,000 sheets per hour.

It is of particular advantage that laser inscribing systems are assigned to the printing cylinders and that therefore plates which can be laser-inscribed are inscribed directly in the printing press in a so-called computer-to-press process. Therefore, no registration difficulties occur as have previously been caused by the mounting of the plates on the printing cylinder or because of errors during the production of the plates. It is therefore possible to omit circumferential, lateral or transverse registration adjustment devices.

The short inking units without inking zones minimize the set-up times and simplify the operation of the printing press. In particular, the short inking units make possible a very small structural size of the entire printing press. The short inking units are each only in contact with one print area of the printing cylinder, so that in the pulled-back state multiple rolling only takes place against a screen roller. By means of different diameters of the application roller and of the screen roller, an existing color relief is reduced in the circumferential direction. The screen roller cooperates with a chamber doctor blade, which completely removes remnants of the ink relief and generates a completely even color film on the screen roller.

Dampening units are omitted when using plates suitable for dry offset printing. Known prior art problems caused by dampening means, for example problems of emulsifying or increased stenciling, cannot be generated.

The feed stack and the delivery stack are located on one side of the press, which improves serviceability. Furthermore, the side to be printed of the sheets to be fed is down, while with the delivered sheets of the delivery stack the printed side is on the top. Therefore the turning of the stack following obverse printing for printing the sheets on the reverse side is not necessary.

The sheet-fed offset rotary printing press in accordance with the invention is compact, minimizes set-up times, simplifies operation and still assures multi-color, stencil-free quality prints with excellent registration. This sheet-fed rotary printing press is particularly suited for small orders in a range between 100 to 20,000 sheets.

Furthermore, an at least double inking of the ink application roller is achieved. The circumferential length of the print area to be inked is less than or equal to a circumferential length of the associated ink application roller.

BRIEF DESCRIPTION OF THE DRAWINGS

The sheet-fed offset rotary printing press in accordance with the present invention is represented in the drawings and will be described in detail in what follows.

Shown are in.

DESCRIPTION OF THE PREFERRED EMBODIMENT

Figure 1:
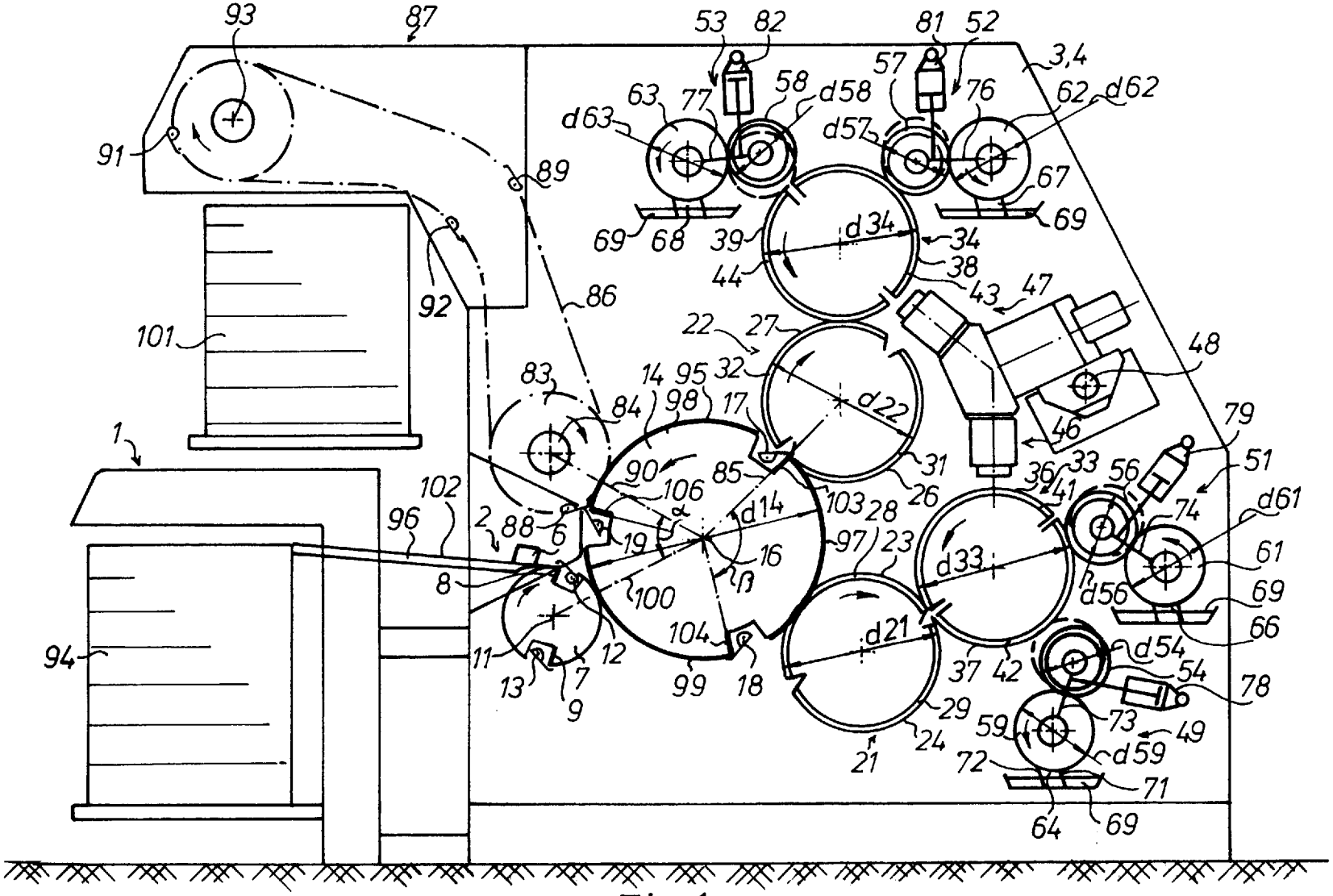
FIG. 1, a schematic side elevation view of the sheet-fed offset rotary printing press; and in FIG. 2, a schematic representation of a cam gear for controlling the ink application rollers.

A stream feeder 1 is placed upstream of a sheet feeder 2 of a sheet-fed offset rotary printing press, as seen in FIG. 1. This sheet feeder 2 is seated in lateral frames 3, 4 of the sheet-fed offset rotary printing press and essentially consists of a lateral alignment device, for example a pull-type or suction guide or lay 6, a sheet-feeding device 7 and front stops 8, 9. For example, the sheet-feeding device 7 is embodied as a rotating stop drum 7, which is provided at the circumference with two gripper systems 12, 13, which are offset by 180° and extend in the direction of an axis of rotation 11 of the stop drum 7. A row, i.e. at least two, front stops 8, 9 are respectively arranged in the area of these gripper systems 12, 13. The drive of the stop drum 7 is provided, for example synchronized with the press cycle, by means of an electric drive, not represented which, respectively within 180° in relation to the stop drum 7, accelerates the latter from a standstill to the circumferential speed of a central impression cylinder 14 and subsequently again brakes it to a standstill. The sheet-feeding device 7 can also be embodied as an oscillator or a suction drum, or can operate in stages with a combination of a suction drum and stop drum or oscillator, and is arranged below the sheets to be fed.

The central impression cylinder 14 has a diameter d14, for example d14=396 mm, which corresponds to three times the nominal diameter dn=132 mm, and is provided with the gripper systems 17, 18, 19, which are offset by respectively 120° about the impression cylinder 14 and extend parallel with its axis of rotation 16. For opening and closing, these controllable gripper systems 17, 18, 19, which cooperate with gripper supports 103, 104, 106, are actuated by means of cam rollers cooperating with adjustable control cams. Two rubber blanket cylinders 21, 22, which each have a diameter d21 or d22 that is twice the nominal diameter dn, for example, d21=264 mm or respectively d22=264 mm, are provided. These blanket cylinders 21, 22 respectively have opposing print areas 23, 24, or respectively 26, 27, which are located opposite each other, and which cooperate with this impression cylinder 14. The respective rubber blanket cylinders 21, 22 can each be covered with two rubber blankets 28, 29, or respectively 31, 32, corresponding to the associated print areas 23, 24, or respectively 26, 27, but also can each be covered with a single rubber blanket corresponding to the two print areas 23, 24, or respectively 26, 27. Corresponding printing cylinders 33, 34 are associated with these rubber blanket cylinders 21, 22. The printing cylinders 33, 34 of a diameter d33, or respectively d34, for example d33=264 mm or respectively d34=264 mm, which is twice the nominal diameter dn, also have two print areas 36, 37, or respectively 38, 39 associated with the print areas 23, 24, or respectively 26, 27 of the rubber blanket cylinders 21, 22. These print areas 36, 37, or respectively 38, 39 are constituted, for example, by plates 41, 42, or respectively 43, 44 supporting printing formes. Each one of these print areas 36, 37, or respectively 38, 39 of the printing cylinder 33, 34 can be provided with its own plate 41, 42, or respectively 43, 44, or both print areas 36, 37, or respectively 38, 39 can have a common plate, which then supports two printing formes. Special plates 41, 42, 43, 44, suitable for waterless offset printing, are preferably used, so that dampening units can be omitted. The described sheet-fed offset rotary printing press operates with flat printing plates. However, it is also possible to use letterpress printing plates (letter set). With direct letterpress printing, i.e. for direct multi-color printing the rubber blanket cylinders 21, 22 can be omitted.

Its own laser inscribing system 46, 47 is associated with each printing cylinder 33, 34 and is used for the direct inscribing of plates 41, 42, 43, 44 suited for such laser inscribing. Prior to inscribing, these plates 41, 42, 43, 44 are positioned on the printing cylinders 33, 34 and can be individually supplied to the printing cylinders 33, 34. However, it is also possible to provide each printing cylinder 33, 34 with a hollow interior space and to arrange in that space a supply and support spindle of a foil which can be inscribed by laser.

The rubber blanket and printing cylinders 21, 22, or respectively 33, 34 can each be equipped with more than two print areas, wherein the impression cylinder 14 then supports one gripper system more or less than the number of print areas of a printing cylinder 33, 34. The number of the gripper systems 17, 18, 19 of the impression cylinder 14 is not equal to the number of the print areas 36, 37 of the printing cylinder 33.

In the preferred embodiment, the two laser inscribing systems 46, 47 are seated on a cross bar 48 extending parallel with the axis of rotation 16 of the impression cylinder 14. For example, in this case a plurality of independent laser diodes are located in a fixed location and are respectively connected with one end of an optical wave guide. The other ends of the optical wave guides are arranged close to each other on a carriage, wherein a plurality, for example 64 of the optical wave guides is respectively oriented toward each printing cylinder 33, 34. The carriage can be axially displaced on the cross bar 48 parallel with the longitudinal directions of the printing cylinders 34, 35. In this way, the two printing cylinders 33, 34 can be inscribed at the same time. It is also possible to omit the axially movable carriage and to arrange the optical wave guides fixed in place and oriented toward the respective printing cylinders 33, 34, wherein then a number of optical wave guides corresponding to the desired resolution of the print image is provided over a total length of the printing cylinders 33, 34.

It is also possible to arrange a single inscribing system, which can be selectively associated with each one of the two printing cylinders 33, 34. For example a pivoting device, or one whose beams are deflected in such a way that both printing cylinders 33, 34 can be inscribed can be provided.

Each one of the print areas 36, 37, 38, 39 of the two printing cylinders 33, 34 is inked by its own inking unit 49, 51, 52, 53. For this purpose, the inking units 49, 51, 52, 53 can be alternatingly placed against and removed from the printing cylinder 33, 34, so that respectively only the associated print areas 36, 37, 38, 39 are inked. In the present preferred embodiment, the inking units 49, 51, 52, 53 are designed as short inking units 49, 51, 52, 53. These short inking units 49, 51, 52, 53 essentially each consists of an ink application roller 54, 56, 57, 58, which inks the print areas 36, 37, 38, 39, a driven screen roller 59, 61, 62, 63, a chamber doctor blade 64, 66, 67, 68, and a catch basin 69. The respective ink application roller 54, 56, 57, 58 can also be embodied to be driven, wherein it is possible to provide a common drive with each associated screen roller 59, 61, 62, 63, or an individual independent drive which, for example, can be regulated. A diameter d54, d56, d57, d58, for example=123 mm, of each of the ink application rollers 54, 56, 57, 58 is different from, and preferably greater than a diameter d59, d61, d62, d63, for example=117 mm, of each of the screen rollers 59, 61, 62, 63. In this way, a circumferential length of the print area 36, 37, 38, 39 to be inked is less than or equal to the circumferential length of the associated ink application roller 54, 56, 57, 58. Each chamber doctor blade 64, 66, 67, 68 has a working and a finished doctor blade 71, 72 and supplies the screen roller 59, 61, 62, 63, with which it is associated, with ink, which is metered by means of the working doctor blade 71. Surplus ink, which is removed from the screen rollers 59, 61, 62, 63 by means of the respective finishing doctor blade 72, is received by the catch basin 69 and is returned to an ink cycle. The screen rollers 59, 61, 62, 63 and the rubber-coated ink application rollers 54, 56, 57, 58 are in constant contact with each other, while the ink application rollers 54, 56, 57, 58 can be placed against the respective print area 36, 37, 38, 39 in synchronization with the respective printing cylinder 33, 34. To this end, the respective ink application rollers 54, 56, 57, 58 are seated on both sides in single-armed levers 72, 73, 74, 76, which are pivotable around the screen roller 59, 61, 62, 63. These levers 72, 73, 74, 76 can be actuated mechanically, for example by means of a cam gear, or electrically, for example by means of a magnet valve cooperating with a work cylinder 78, 79, 81, 82, which can be charged with a pressure medium. In place of the described short inking units 49, 51, 52, 53, it is also possible to use conventional inking units provided with ink ducts and duct-adjusting screws. In this case, their ink application rollers are in constant contact with the remaining ink rollers of the conventional inking units, and can be moved toward or away from the respective printing cylinder 33, 34 while only inking the respective associated print area 36, 37, 38, 39.

A chain wheel shaft 84, which cooperates with the impression cylinder 14 and has chain wheels 83, is arranged in the production direction downstream of the two rubber blanket cylinders 21, 22. A length l, for example 414 mm, of an arc of a circle 95, delimited by two median lines 85, 90 of the rubber blanket cylinder 22 and the impression cylinder 14, or respectively the chain wheel shaft 8 and the impression cylinder 14, on the jacket surface of the impression cylinder 14, is greater than a length, for example 360 mm, of the sheets of maximum format permissible for this machine. An angle alpha, for example alpha=60°, formed by the median line 90 of the impression cylinder 14 and the chain wheel shaft 84, and by the median line 100 of the printing cylinder 14 and the stop drum 7, is less than an angle beta, for example beta=120°, formed by two successive gripper systems 17, 18. The chain wheel shaft 84 conducts a chain 86 of a chain gripper delivery device 87. This chain 86 is equipped with, for example four, chain gripper systems 88, 89, 91, 92, wherein a distance "a", for example a=829 mm, of two chain gripper systems 88, 89, 91, 92 in respect to each other when the chain 86 is stretched, corresponds to a circumferential length of a rubber blanket cylinder 21 or 22, or of a plate cylinder 33, 34. This endless chain 86 equipped in this manner is reversed by a second chain wheel shaft 93 and runs back to the impression cylinder 14. However, this distance "a" can also be made shorter if the chain runs unevenly, for example slowed for sheet delivery.

The operation of the sheet-fed offset rotary printing press in accordance with the present invention is as follows: the stream feeder 1 separates sheets from a stack of sheets 94 and feeds these sheets over a suction belt table 96 to the stop drum 7, which is at rest. There, a front edge of a first fed sheet 97 is aligned at the front stops 8 parallel in respect to the axis of rotation 11 of the stop drum 7. Subsequently, the pull-type or suction guide or lay 6 grips the sheet 97 and aligns it laterally. Following the alignment of the sheet 97, the gripper system 12 of the stop drum 7 is closed, and the stop drum 7 accelerates the sheet 97 from a standstill to the circumferential speed of the impression cylinder 14. After having reached this circumferential speed, the gripper system 12 of the stop drum 7 transfers the sheet 97 to the first gripper system 17 of the impression cylinder 14. The latter conveys the sheet 97 to the first rubber blanket cylinder 21 and the sheet 97 is printed by the print area 23 of the first rubber blanket cylinder 21. Previously, the plate 41 of the printing cylinder 33, which had been inked by the inking unit 49 with, for example, black ink, had transferred its print image to the ink area 23 of the rubber blanket cylinder 21. The sheet 97, provided with a first printed image in this way and held by the gripper system 17, is then transported to the second rubber blanket cylinder 22. There the sheet 97 is printed with the second print image by the print area 26, which previously had been provided with a second print image, for example in the ink color "cyan", by means of the print unit 52 and the plate 43 of the second printing cylinder 34.

In the meantime, the second gripper system 18 of the impression cylinder 14 passes by the stop drum 7 without picking up a sheet in the process.

The third gripper system 19 of the impression cylinder 14 now takes up the second sheet 98 from the second gripper system 13 of the stop drum 7, which second sheet 98 is fed to the stop drum 7 and aligned in the same manner as the first sheet 97. This second sheet 98, too, is first imprinted by the print area 23 of the first rubber blanket cylinder 21 having the print image of the plate 41, and then by the print area 26 of the second rubber blanket cylinder having the print image of the plate 43.

In the course of this, the first sheet 97 was conveyed past the chain wheel shaft 84 and the stop drum 7 without the gripper system 17 being opened. The first sheet 97 now reaches the rubber blanket cylinders 21 and 22 for the second time. But now the sheet 97 is imprinted by the second print area 24 with the third print image which was transferred to the print area 24 by the plate 42 inked, for example, with the print color "magenta" by the print unit 51. The fourth print image was transferred to the second print area 27 of the second rubber cylinder 22 by the plate 44 inked, for example, with yellow printing ink by means of the inking unit 53. This print area 44 prints the sheet 97 with the fourth print image.

In the meantime the second gripper system 18 has taken up a third sheet 99 from the first gripper system 12 of the stop drum 7, which now, the same as the first and second sheets 97, 98, is initially imprinted by the print areas 23 or respectively 26 of the rubber blanket cylinders 21, or respectively 22. At the end of the fourth printing operation, the completely printed first sheet 97, provided with four color print images, is taken over by the chain gripper system 91 in the area of the chain wheel shaft 84, even at maximum format length, for example 360 mm. In the process, the gripper system 17 is opened for the first time after having taken over the unprinted sheet 97 from the first gripper system 12 of the stop drum 7, thus the sheet 97 was imprinted with four print images during one closure of the gripper. This chain gripper system 91 transports the sheet 97 in the chain gripper delivery device 87 as far as into the area of a stack 101. There, the chain gripper system 91 is opened and the sheet 97 is deposited on the stack 101. The now empty gripper system 17 subsequently takes over a fourth sheet 102 from the gripper system 12 of the stop drum 7.

The second gripper system 18 transports the third sheet 99, imprinted with two print images, past the chain wheel shaft 84, while the second sheet 98, in the meantime provided with four print images, is transferred to the chain gripper system 92 and is transported to the stack 101.

These described processes are periodically repeated, so that respectively one sheet imprinted with four print images reaches the chain gripper delivery device 87 per revolution of the printing cylinders 33, 34, or respectively the rubber blanket cylinders 21, 22, and is deposited there on the stack 101.

Figure 2:
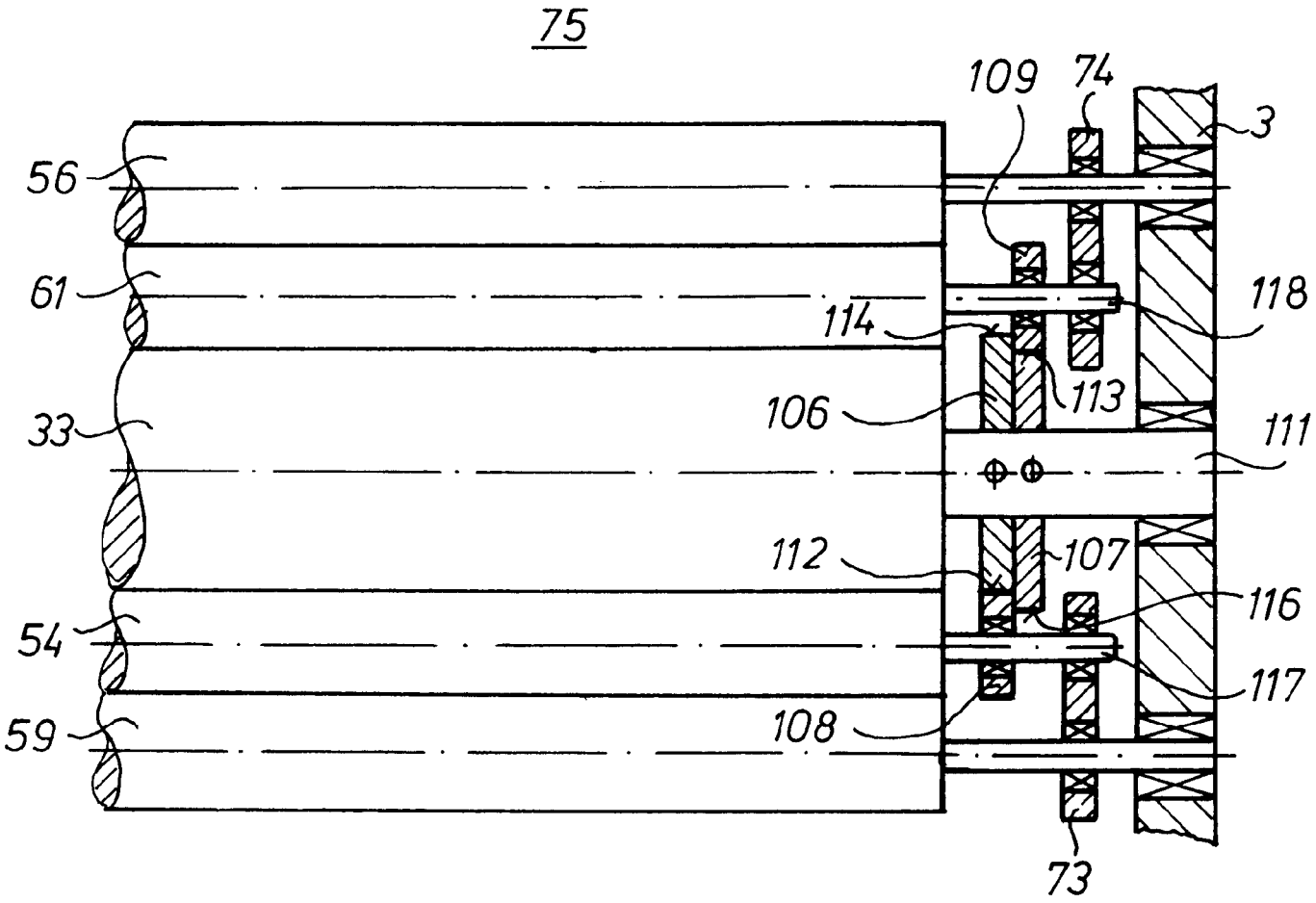

The above mentioned cam gears 75 for advancing or retracting the ink application rollers 54, 56, 57, 58 can, as may be seen in FIG. 2, essentially consist on each side of, for example, respectively one pair of cam disks 106, 107 and two cam rollers 108, 109 cooperating with them, and are described by way of example by means of a cam gear 75 of the printing cylinder 33. The cam disks 106, 107 are rigidly fastened on a journal 111 of the respective printing cylinder 33 and rotate with it. A jacket surface of each cam disk 106, 107 is provided in the circumferential direction with an arc-shaped depression 112, 113, matched to the associated print area 36, 37, and an oppositely located arc-shaped prominence 114, 116, which are connected by means of gentle transition curves located in the area of a conduit of the printing cylinder 33. For example, the cam rollers 108, 109 are rotatably seated on a journal 117, or respectively 118 of the ink application roller 54, or respectively 56. The cam rollers 108, 109 of both ink application rollers 54, 56, which resiliently cooperate with a printing cylinder 33, are offset in the axial direction in respect to each other, so that a cam disk 106, 107 is associated with each cam roller 108, 109. Because of the rotation of the cam disks 106, 107 along with the printing cylinder 33, the prominence 114, 116 and the depression 112, 113 of the respective cam disk 106, 107 alternatingly cooperate in such a way that during the cooperation of the depression 112, 133 with the cam roller 108, 109 the ink application roller 54, 56 is placed against the printing cylinder 33, and while the prominence 114, 116 cooperates with the cam roller 108, 109, the ink application roller 54, 56 is lifted off the printing cylinder.

While a preferred embodiment of a sheet-fed offset rotary printing machine in accordance with the present invention has been set forth fully and completely hereinabove, it will be apparent to one of skill in the art that a number of changes in, for example, the overall drive for the printing machine, the speed of operation of the machine, the type of paper sheet being provided, and the like can be made without departing from the true spirit and scope of the present invention, which is accordingly to be limited only by the following claims.

What is claimed is:

1. A sheet-fed rotary printing press for multi-color printing comprising:

a central impression cylinder having controllable gripper systems;

a plurality of printing cylinders associated with said central impression cylinder, each of said printing cylinders having at least two print areas; and a short inking system associated with each said print area, each said short inking system having a chamber doctor blade, a screen roller and at least one ink application roller, wherein a circumferential length of each said print area is less than or equal to a circumferential length of an associated one of said ink application rollers.

2. The sheet-fed rotary printing press of claim 1 wherein each said ink application roller is in constant contact with said associated screen roller and is positionable against and removable from contact with said associated printing cylinder.

3. The sheet-fed rotary printing press of claim 1 wherein each said short inking unit has a single ink application roller.

4. The sheet-fed rotary printing press of claim 1 wherein each said ink application roller cooperates directly with said screen roller and said associated print area of said associated printing cylinder.

5. The sheet-fed rotary printing press of claim 1 wherein each said ink application roller is supported by spaced levers which can be pivoted about said associated screen roller.

6. A sheet-fed rotary printing press for direct multi-color printing comprising:

a central impression cylinder having a plurality of controlled gripper systems;

a first print cylinder having at least two print areas associated with said impression cylinder, said number of gripper systems being not equal to said number of print areas;

means for feeding sheets to be printed from a stack of sheets to said central impression cylinder and means for delivering printed sheets from said central impression cylinder to a stack of delivered sheets, said means for feeding and delivering sheets being situated on the same side of said sheet-fed rotary printing press;

at least a second printing cylinder associated with said central impression cylinder;

a sheet delivery gripper system associated with said central impression cylinder, a sheet printed by said printing press being taken over by said sheet delivery gripper system at the termination of printing of a sheet by said central impression cylinder and said associated print cylinders; and at least one short inking unit associated with each said print cylinder.

* * * * *